US009952553B2

(12) United States Patent
Noda et al.

(10) Patent No.: US 9,952,553 B2
(45) **Date of Patent: *Apr. 24, 2018**

(54) DEVELOPING CARTRIDGE PROVIDED WITH RECEIVING MEMBER CAPABLE OF EFFICIENTLY TRANSMITTING DRIVE FORCE TO DEVELOPER CARRIER

(71) Applicant: Brother Kogyo Kabushiki Kaisha, Nagoya-shi, Aichi-ken (JP)

(72) Inventors: Ryuji Noda, Setao (JP); Takashi Shimizu, Nagoya (JP); Keita Shimizu, Tsushima (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/240,654

(22) Filed: Aug. 18, 2016

(65) Prior Publication Data

US 2016/0357140 A1 Dec. 8, 2016

Related U.S. Application Data

(63) Continuation of application No. 14/546,005, filed on Nov. 18, 2014, now Pat. No. 9,436,155.

(30) Foreign Application Priority Data

Nov. 18, 2013 (JP) ..... 2013-238354

(51) Int. Cl.

| | |
|---|---|
| ***G03G 15/08*** | (2006.01) |
| ***G03G 21/16*** | (2006.01) |
| *G03G 21/18* | (2006.01) |

(52) U.S. Cl.

CPC ..... *G03G 21/1647* (2013.01); *G03G 15/0865* (2013.01); *G03G 21/186* (2013.01); *G03G 2221/1657* (2013.01)

(58) Field of Classification Search

None

See application file for complete search history.

(56) References Cited

U.S. PATENT DOCUMENTS

| | | | |
|---|---|---|---|
| 5,678,139 | A | 10/1997 | Nomura et al. |
| 5,825,472 | A | 10/1998 | Araki et al. |

(Continued)

FOREIGN PATENT DOCUMENTS

| | | | |
|---|---|---|---|
| JP | 11161093 | A * | 6/1999 |
| JP | 2002-123153 | A | 4/2002 |

(Continued)

OTHER PUBLICATIONS

Jul. 22, 2015—U.S. Non-Final Office Action—U.S. Appl. No. 14/590,407.

(Continued)

*Primary Examiner* — Sevan A Aydin

(74) *Attorney, Agent, or Firm* — Banner & Witcoff, Ltd.

(57) ABSTRACT

A developing cartridge includes: a casing; a developer carrier; and a receiving member. The casing includes a support portion. The receiving member receives a drive force from an external drive source to transmit the drive force to the developer carrier. The receiving member has a cylindrical configuration. The support portion rotatably supports the receiving member. The receiving member includes: a receiving portion; a transmission portion; and a fitting portion. The receiving portion has an outer edge in a radial direction of the receiving member. The transmission portion defines an outer circumferential edge of the receiving member. The fitting portion is positioned inward of the transmission portion in the radial direction and fitted with the support portion. The outer edge of the receiving portion is positioned inward of the transmission portion in the radial direction and outward of the fitting portion in the radial direction.

16 Claims, 8 Drawing Sheets

(56) References Cited

U.S. PATENT DOCUMENTS

| | | | | |
|---|---|---|---|---|
| 6,049,685 | A | 4/2000 | Murakami et al. | |
| 6,898,399 | B2 | 5/2005 | Morioka et al. | |
| 8,417,131 | B2 | 4/2013 | Mori | |
| 2006/0067718 | A1* | 3/2006 | Toda | G03G 15/086 399/27 |
| 2007/0003321 | A1 | 1/2007 | Hara et al. | |
| 2009/0052918 | A1* | 2/2009 | Toda | G03G 15/086 399/55 |
| 2009/0208261 | A1* | 8/2009 | Kobayashi | G03G 15/2064 399/328 |
| 2009/0317135 | A1 | 12/2009 | Miyabe et al. | |
| 2010/0067936 | A1* | 3/2010 | Kitajima | G03G 15/5058 399/72 |
| 2010/0080581 | A1 | 4/2010 | Shimizu | |
| 2010/0142995 | A1 | 6/2010 | Shiraki et al. | |
| 2011/0064486 | A1* | 3/2011 | Furuya | G03G 15/0818 399/281 |
| 2011/0081163 | A1 | 4/2011 | Lee | |
| 2011/0158688 | A1 | 6/2011 | Mori | |
| 2011/0243578 | A1 | 10/2011 | Ukai et al. | |
| 2012/0195634 | A1 | 8/2012 | Kuriki | |
| 2013/0051833 | A1 | 2/2013 | Itabashi et al. | |
| 2013/0051848 | A1 | 2/2013 | Itabashi et al. | |
| 2013/0084084 | A1 | 4/2013 | Itabashi et al. | |
| 2013/0170845 | A1 | 7/2013 | Itabashi | |
| 2013/0248315 | A1* | 9/2013 | Iijima | F16C 13/00 192/46 |
| 2014/0086613 | A1 | 3/2014 | Itabashi et al. | |
| 2014/0105638 | A1 | 4/2014 | Shiraki et al. | |
| 2015/0003868 | A1 | 1/2015 | Shimizu et al. | |
| 2015/0139701 | A1 | 5/2015 | Noda et al. | |
| 2015/0192891 | A1 | 7/2015 | Noda et al. | |
| 2015/0277355 | A1 | 10/2015 | Taguchi | |
| 2015/0280364 | A1 | 10/2015 | Masuda | |
| 2016/0246252 | A1* | 8/2016 | Minoshima | G03G 21/1623 |
| 2017/0017200 | A1* | 1/2017 | Oya | G03G 21/206 |

FOREIGN PATENT DOCUMENTS

| | | | |
|---|---|---|---|
| JP | 2008-242084 | A | 10/2008 |
| JP | 2009-294584 | A | 12/2009 |
| JP | 2011-039561 | A | 2/2011 |
| JP | 2011-133756 | A | 7/2011 |
| JP | 2012-155262 | A | 8/2012 |
| WO | 2011/125695 | A1 | 10/2011 |

OTHER PUBLICATIONS

Jan. 21, 2016—U.S. Notice of Allowance—U.S. Appl. No. 14/590,407.
Mar. 14, 2017—(JP) Office Action—App 2014-000598, Eng Tran.
Feb. 9, 2017—U.S. Non-Final Office Acion—U.S. Appl. No. 15/154,500.
Dec. 13, 2016—(JP) Office Action—App 2013-238354, Eng Tran.
Oct. 25, 2016—(JP) Office Action—App 2014-000599, Eng Tran.
Sep. 7, 2017—U.S. Notice of Allowance—U.S. Appl. No. 15/154,500.

* cited by examiner

DEVELOPING CARTRIDGE PROVIDED WITH RECEIVING MEMBER CAPABLE OF EFFICIENTLY TRANSMITTING DRIVE FORCE TO DEVELOPER CARRIER

CROSS REFERENCE TO RELATED APPLICATION

This application is a continuation of U.S. patent application Ser. No. 14/546,005, filed Nov. 18, 2014, which claims priority from Japanese Patent Application No. 2013-238354 filed Nov. 18, 2013. The entire content of the priority application is incorporated herein by reference.

TECHNICAL FIELD

The present invention relates to a developing cartridge detachably mountable in an image forming apparatus employing an electrophotographic method.

BACKGROUND

As a developing cartridge mountable in an image forming apparatus employing an electrophotographic method, there is conventionally known a developing cartridge including a developing roller on which toner is carried. The developing cartridge is configured to be mounted in an image forming apparatus in a state where the developing cartridge is mounted in a drum cartridge including a photosensitive drum.

As such a developing cartridge, there is known a developing cartridge including a coupling gear that is configured to receive a drive force from a main body of an image forming apparatus and to transmit the drive force to a developing roller.

SUMMARY

In the developing cartridge described above, an inner diameter of a connection portion of the coupling gear is small. Accordingly, there may be a case where the coupling gear is difficult to rotate, such as when a torque of the developing roller is increased.

When this is the case, in order to rotate the coupling gear, a greater drive force is required to be inputted into the coupling gear from the main body.

However, when the drive force from the main body is made greater, the coupling gear may be damaged.

In view of the foregoing, it is an object of the present invention to provide a developing cartridge capable of efficiently transmitting a drive force from an external drive source to a developer carrier while suppressing damages to a receiving member.

In order to attain the above and other objects, the present invention provides a developing cartridge that may include: a casing; a developer carrier; and a receiving member. The casing may be configured to accommodate a developer therein and include a support portion. The developer carrier may be rotatably supported at the casing and configured to carry the developer thereon. The developer carrier may have a rotation axis extending in an axial direction. The receiving member may be configured to receive a drive force from an external drive source to transmit the drive force to the developer carrier. The receiving member may have a cylindrical configuration with an axis extending parallel to the rotation axis of the developer carrier and be configured to rotate about the axis. The support portion may be configured to support the receiving member such that the receiving member is capable of rotating relative to the support portion. The receiving member may include: a receiving portion; a transmission portion; and a fitting portion. The receiving portion may extend in a radial direction of the receiving member and be configured to receive the drive force from the external drive source. The receiving portion may have an outer edge in the radial direction. The transmission portion may be configured to transmit the drive force received by the receiving portion to the developer carrier and define an outer circumferential edge of the receiving member. The fitting portion may be positioned inward of the transmission portion in the radial direction and have a cylindrical configuration fitted with the support portion so as to be capable of rotating relative to the support portion. The outer edge of the receiving portion may be positioned inward of the transmission portion in the radial direction and outward of the fitting portion in the radial direction.

DETAILED DESCRIPTION

1. Overall Structure of Developing Cartridge

Figure 1:
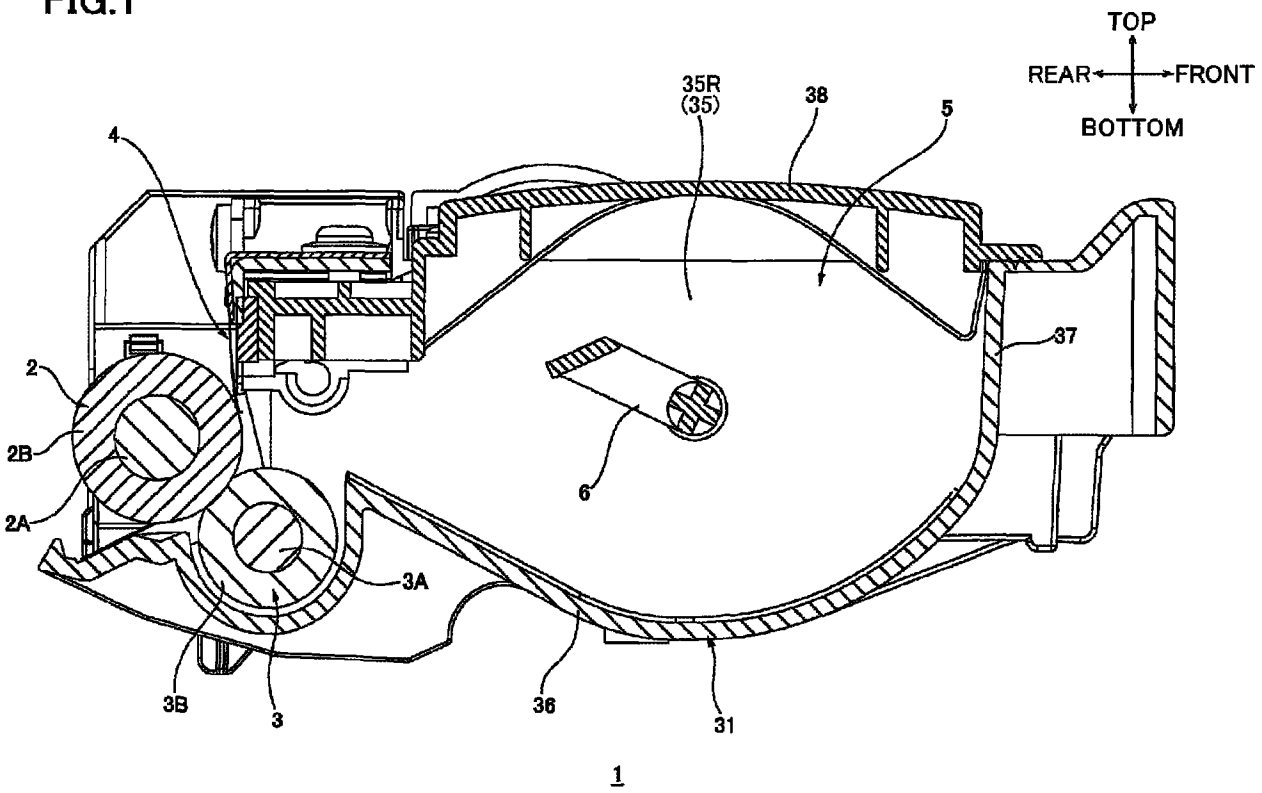
FIG. 1 is a center cross-sectional view of a developing cartridge according to one embodiment of the present invention.

A developing cartridge 1 according to one embodiment of the present invention will be described with reference to FIG. 1, wherein like parts and components are designated by the same reference numerals to avoid duplicating description.

As shown in FIG. 1, the developing cartridge 1 includes a developing roller 2 as an example of a developer carrier, a supply roller 3, a layer thickness regulation blade 4, and a toner accommodation portion 5.

Directions, such as "upward", "downward", "upper", "lower", "above", "below", "beneath", "right", "left", "front", "rear" and the like, in the following description related to the developing cartridge 1 will be given based on a state of the developing cartridge 1 when the developing cartridge 1 is placed on a level surface. Hence, a top side and a bottom side in FIG. 1 are a top side and a bottom side of the developing cartridge 1, respectively. Further, a right side and a left side in FIG. 1 are a front side and a rear side of the developing cartridge 1, respectively. Further, a right side and a left side of the developing cartridge 1 will be based on the perspective of a user facing the front side of the developing cartridge 1. Therefore, a near side and a far side in FIG. 1 are the left side and the right side of the developing cartridge 1, respectively.

The developing roller 2 is rotatably supported in a rear end portion of the developing cartridge 1. The developing roller 2 includes a developing roller shaft 2A and a developing roller body 2B.

The developing roller shaft 2A has a general cylindrical shape. The developing roller shaft 2A extends in a left-right direction. The developing roller shaft 2A is made of metal.

The developing roller body 2B is a general cylindrical shape. The developing roller body 2B extends in the left-right direction. The developing roller body 2B is made of rubber having electrically conductive properties. The developing roller body 2B covers a generally intermediate portion of the developing roller shaft 2A in the left-right direction, while both end portions of the developing roller shaft 2A in the left-right direction are exposed.

The supply roller 3 is disposed on a lower front side of the developing roller 2. The supply roller 3 is rotatably supported to a lower rear end portion of the developing cartridge 1. The supply roller 3 includes a supply roller shaft 3A and a supply roller body 3B.

The supply roller shaft 3A has a general cylindrical shape. The supply roller shaft 3A extends in the left-right direction. The supply roller shaft 3A is made of metal.

The supply roller body 3B has a general cylindrical shape. The supply roller body 3B extends in the left-right direction. The supply roller body 3B is made of sponge having electrically conductive properties. The supply roller body 3B covers a generally intermediate portion of the supply roller shaft 3A in the left-right direction, while both end portions of the supply roller shaft 3A in the left-right direction are exposed. The supply roller body 3B contacts a lower front edge of the developing roller body 2B.

The layer thickness regulation blade 4 is positioned above and frontward of the developing roller 2. The layer thickness regulation blade 4 contacts a front edge of the developing roller 2.

The toner accommodation portion 5 is positioned in front of the supply roller 3 and the layer thickness regulation blade 4. The toner accommodation portion 5 is configured to accommodate toner as an example of a developer therein. The toner accommodation portion 5 includes an agitator 6.

The agitator 6 is rotatably supported in the toner accommodation portion 5.

2. Usage of Developing Cartridge

Figure 2:
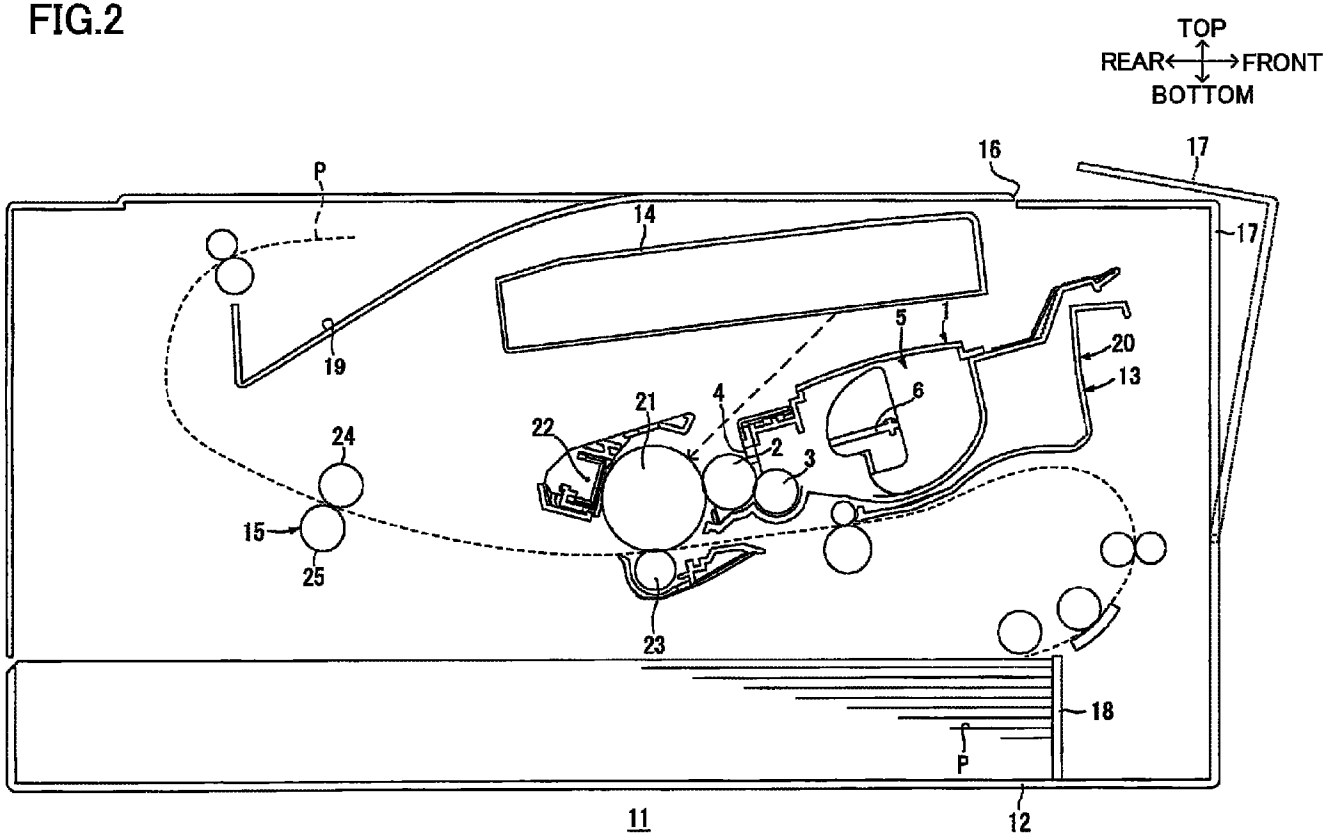
FIG. 2 is a center cross-sectional view of a printer in which the developing cartridge in FIG. 1 is mounted.

As shown in FIG. 2, in order to use the developing cartridge 1, the developing cartridge 1 is mounted in an image forming apparatus 11.

Directions in the following description related to the image forming apparatus 11 will be given based on a state of the image forming apparatus 11 when the image forming apparatus 11 is resting on a level surface. More specifically, a top side and a bottom side in FIG. 2 are a top side and a bottom side of the image forming apparatus 11, respectively. Further, a right side and a left side in FIG. 2 are a front side and a rear side of the image forming apparatus 11, respectively. Further, a right side and a left side of the image forming apparatus 11 will be based on the perspective of a user facing the front side of the image forming apparatus 11. Therefore, a near side and a far side in FIG. 2 are the left side and the right side of the image forming apparatus 11, respectively.

The image forming apparatus 11 includes an apparatus casing 12 as an example of an external, a process cartridge 13, a scanning unit 14, and a fixing unit 15.

The apparatus casing 12 has a general box-like shape. The apparatus casing 12 includes a front cover 17, a sheet supply tray 18, and a sheet discharge tray 19.

The apparatus casing 12 has an opening 16 formed in a front end thereof. The opening 16 communicates with an interior and an exterior of the apparatus casing 12 in a front-rear direction to allow passage of the process cartridge 13.

The front cover 17 is provided at the front end of the apparatus casing 12. The front cover 17 has a general plate-like shape. The front cover 17 extends vertically. The front cover 17 is supported to a front wall of the apparatus casing 12 so as to be pivotally movable about its lower end portion between an open position for opening the opening 16 and a closed position for closing the opening 16.

The sheet supply tray 18 is provided at a bottom portion of the apparatus casing 12. The sheet supply tray 18 is configured to accommodate sheets P of paper.

The sheet discharge tray 19 is provided at a front-half of a top wall of the apparatus casing 12. The sheet discharge tray 19 is recessed downward form an upper surface of the apparatus casing 12 so as to receive the sheets P thereon.

The process cartridge 13 is accommodated in the apparatus casing 12 at a substantially vertical center portion thereof. The process cartridge 13 is configured to be attached to and detached from the apparatus casing 12 through the opening 16. The process cartridge 13 includes a drum cartridge 20 and the developing cartridge 1.

The drum cartridge 20 includes a photosensitive drum 21, a scorotron charger 22, and a transfer roller 23.

The photosensitive drum 21 is rotatably supported in a rear end portion of the drum cartridge 20.

The scorotron charger 22 is positioned on a rear side of the photosensitive drum 21 while being spaced apart therefrom.

The transfer roller 23 is positioned below the photosensitive drum 21. The transfer roller 23 contacts a lower edge of the photosensitive drum 21.

The developing cartridge 1 is mounted in the drum cartridge 20 at a position in front of the photosensitive drum 21 such that the developing roller 2 contacts a front edge of the photosensitive drum 21.

The scanning unit 14 is disposed above the process cartridge 13. The scanning unit 14 is adapted to irradiate a laser beam based on image data toward the photosensitive drum 21, as indicated by a dashed line in FIG. 2.

The fixing unit 15 is disposed rearward of the process cartridge 13. The fixing unit 15 includes a heating roller 24, and a pressure roller 25 that contacts a lower rear edge of the heating roller 24 with pressure.

When the image forming apparatus 11 starts an image-forming operation, the scorotron charger 22 applies a uniform charge to a surface of the photosensitive drum 21. Subsequently, the scanning unit 14 exposes the charged surface of the photosensitive drum 21 to the laser beam, thereby forming an electrostatic latent image based on image data on the surface of the photosensitive drum 21.

In the meantime, the agitator 6 agitates toner accommodated in the toner accommodation portion 5 to supply the toner to the supply roller 3. The supply roller 3 supplies the toner supplied by the agitator 6 to the developing roller 2. At this time, the toner is positively tribocharged between the developing roller 2 and the supply roller 3, and the layer thickness regulation blade 4 regulates the thickness of the toner carried on the developing roller 2 so as to maintain the toner on the developing roller 2 at a thin uniform thickness.

Next, the toner carried on the developing roller 2 is supplied to the electrostatic latent image formed on the surface of the photosensitive drum 21, producing a toner image on the surface of the photosensitive drum 21.

Various rollers in the image forming apparatus 11 rotate to convey the sheets P from the sheet supply tray 18, and supply the sheets P one sheet at a time between the photosensitive drum 21 and the transfer roller 23 at a prescribed timing. As the sheet P passes between the photosensitive drum 21 and the transfer roller 23, the toner image on the surface of the photosensitive drum 21 is transferred onto the sheet P.

Subsequently, the heating roller 24 and the pressure roller 25 apply heat and pressure to the sheet P as the sheet P passes therebetween. At this time, the toner image is thermally fixed to the sheet P. Then, the sheet P is discharged onto the sheet discharge tray 19.

3. Detailed Description of Developing Cartridge

Figure 3:
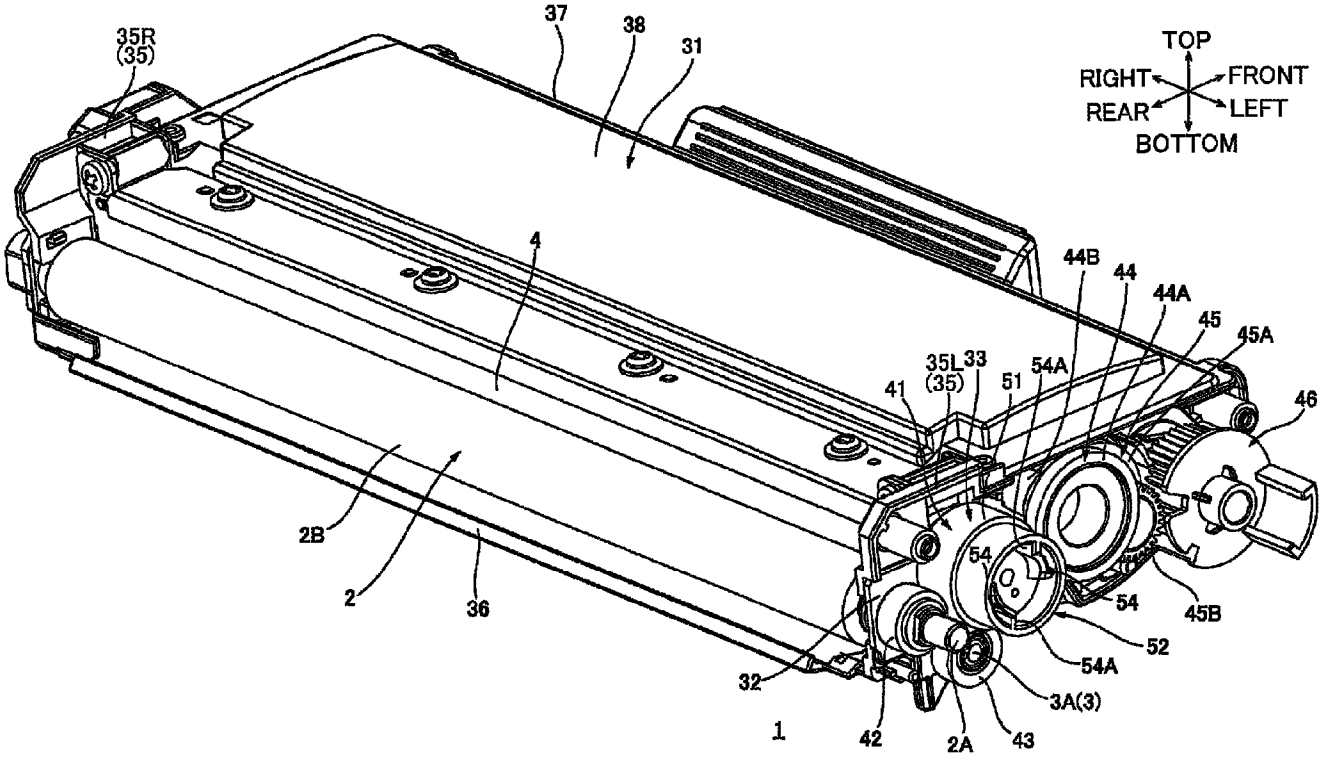
FIG. 3 is a perspective view of the developing cartridge in FIG. 1 as viewed from a left rear side thereof, in which a gear cover for covering a gear train is omitted to show the gear train.

As shown in FIG. 3, the developing cartridge 1 includes a developing frame 31 as an example of a casing, and a gear train 33.

(1) Developing Frame

The developing frame 31 has a substantially box-like shape. The developing frame 31 includes a pair of side walls 35, a bottom wall 36, a front wall 37, a top wall 38, and a bearing member 32.

The pair of side walls 35 incudes a left side wall 35L and a right side wall 35R. The left side wall 35L constitutes a left end of the developing frame 31, while the right side wall 35R constitutes a right end of the developing frame 31. Each of the pair of side walls 35 has a flat plate shape that is substantially rectangular in a side view and extends in the front-rear direction.

The bottom wall 36 has a substantially flat plate shape that extends in the front-rear direction. A left end of the bottom wall 36 continues to a lower edge of the left side wall 35L, while a right end of the bottom wall 36 continues to a lower edge of the right side wall 35R.

The front wall 37 continues from a front edge of the bottom wall 36 and extends upward therefrom. The front wall 37 has a flat plate shape that is substantially rectangular in a front view. A left end of the front wall 37 continues to a front edge of the left side wall 35L, while a right end of the front wall 37 continues to a front edge of the right side wall 35R.

The top wall 38 has a flat plate shape that is substantially rectangular in a plan view. A front edge of the top wall 38 continues from a top edge of the front wall 37. A left end of the top wall 38 continues to a top edge of the left side wall 35L, while a right end of the top wall 38 continues to a top edge of the right side wall 35R.

Figure 5:
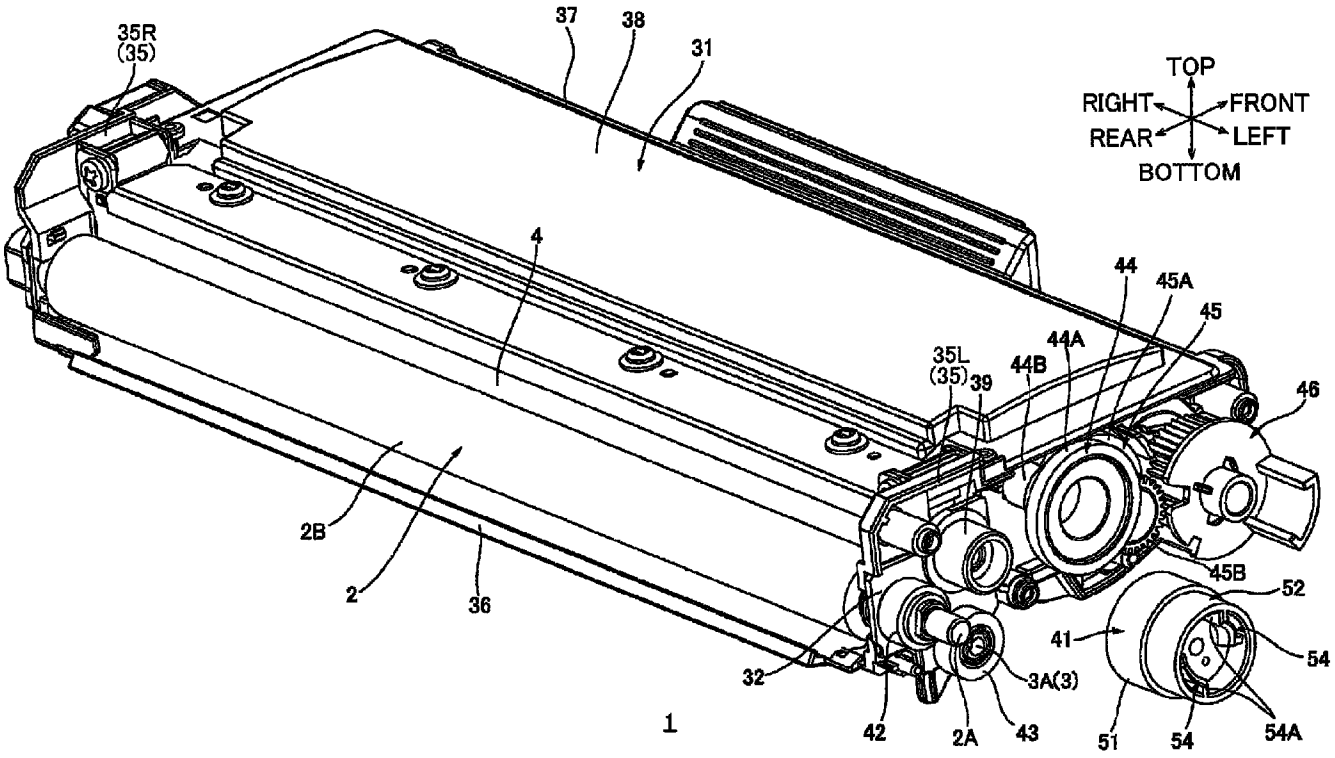
FIG. 5 is a perspective view of the developing cartridge in FIG. 3 as viewed from a left rear side thereof, in which a developing coupling is removed.

As shown in FIG. 5, the bearing member 32 is supported in a rear end portion of the left side wall 35L. The bearing member 32 has a flat plate shape that is substantially rectangular in a side view. The bearing member 32 has a rear end portion at which the developing roller shaft 2A is rotatably supported, and a lower end portion at which the supply roller shaft 3A is rotatably supported. The bearing member 32 includes a coupling support boss 39 as an example of a support portion.

As shown in FIG. 5, the coupling support boss 39 is disposed at an upper front end portion of the bearing member 32. The coupling support boss 39 has a substantially cylindrical shape that projects leftward from a left surface of the bearing member 32.

(2) Gear Train

Figure 4:
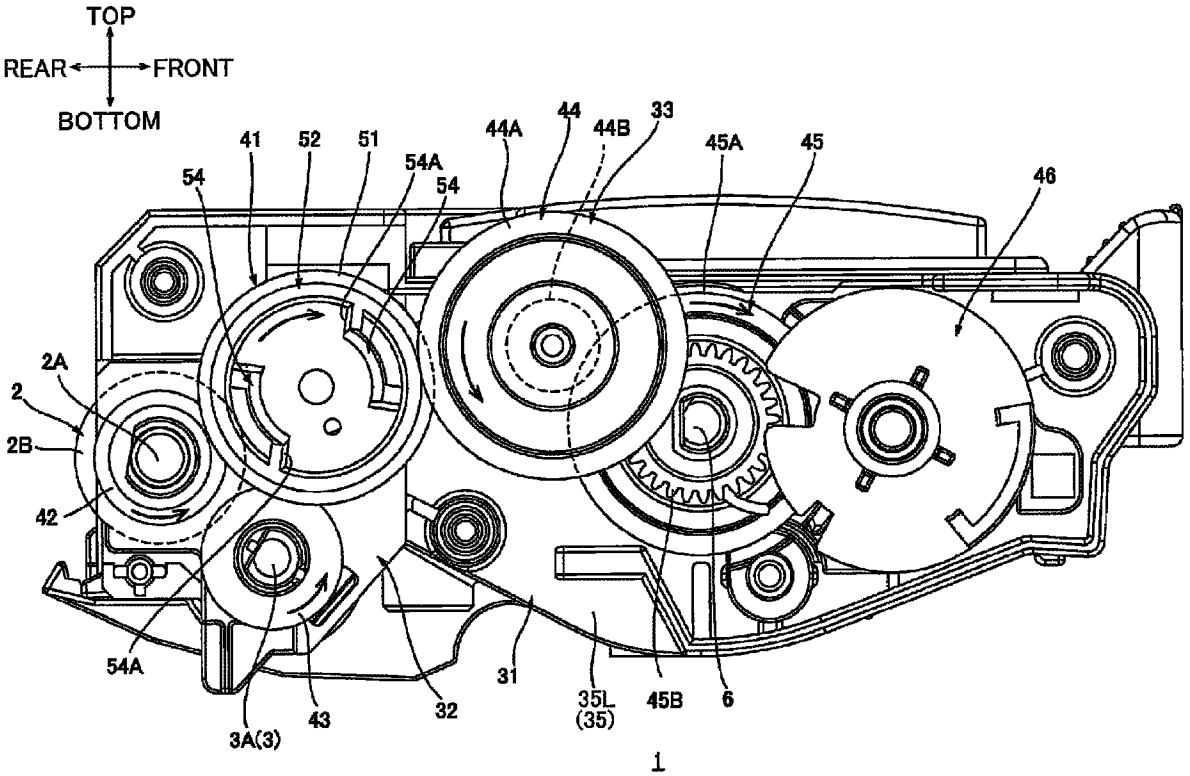
FIG. 4 is a left side view of the developing cartridge in FIG. 3.

As shown in FIGS. 3 and 4, the gear train 33 includes a developing coupling 41 as an example of a receiving member, a developing gear 42, a supply gear 43, an idle gear 44, an agitator gear 45, and a detection gear 46. The gear train 33 is disposed at a left end portion of the developing cartridge 1 at a position leftward of the developing frame 31. Incidentally, the gear train 33 is covered with a gear cover (not shown).

Figure 6A:
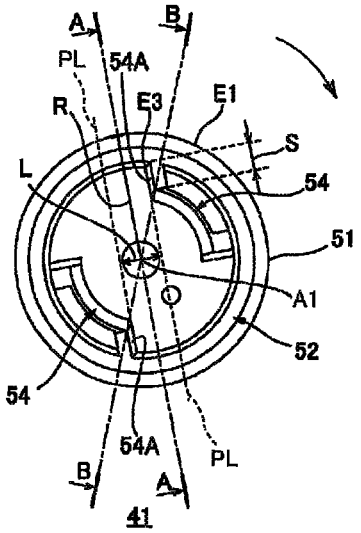
FIG. 6A is a left side view of the developing coupling in FIG. 5.
Figure 6B:
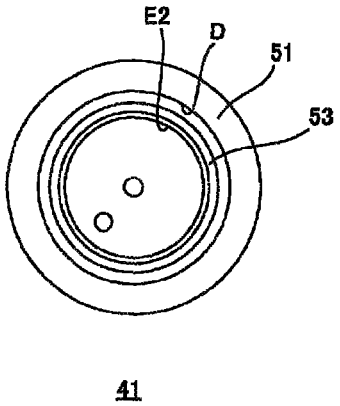
FIG. 6B is a right side view of the developing coupling in FIG. 5.

The developing coupling 41 is disposed at a rear end portion of the developing cartridge 1. The developing coupling 41 has a substantially cylindrical shape that extends in the left-right direction. The developing coupling 41 has a rear end portion that overlaps the developing roller body 2B of the developing roller 2 when projected in the left-right direction. As shown in FIGS. 6A and 6B, the developing coupling 41 includes a gear portion 51 as an example of a transmission portion, a fitting portion 53, and a coupling portion 52.

Figure 7A:
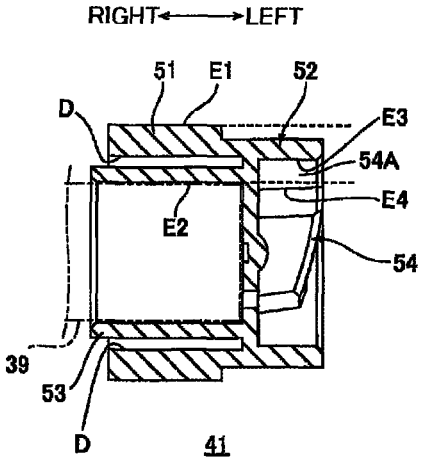
FIG. 7A is a cross-sectional view of the developing coupling in FIG. 6A taken along a line A-A in FIG. 6A.

As shown in FIGS. 6A and 7A, the gear portion 51 is disposed at a substantially right half of the developing coupling 41. The gear portion 51 has a substantially hollow cylindrical shape that extends in the left-right direction and is closed on a left end thereof. The gear portion 51 has a center axis A1 that is coincident with a rotation axis of the developing coupling 41. The gear portion 51 has gear teeth over an entire circumference thereof.

As shown in FIGS. 6B and 7A, the fitting portion 53 is disposed on an inner side of the gear portion 51 in a radial direction of the gear portion 51. The fitting portion 53 has a substantially hollow cylindrical shape that extends rightward from a right surface of a left wall of the gear portion 51. The fitting portion 53 shares the center axis A1 with the gear portion 51. That is, the fitting portion 53 is coaxial with the gear portion 51. An outer diameter of the fitting portion 53 is smaller than an inner diameter of the gear portion 51. An inner diameter of the fitting portion 53 is substantially equal to an outer diameter of the coupling support boss 39. An outer circumferential surface of the fitting portion 53 is spaced away from an inner circumferential surface of the gear portion 51 by a distance D. A right end of the fitting portion 53 projects rightward further than a right end of the gear portion 51. The fitting portion 53 is fitted with the coupling support boss 39 of the developing frame 31 from an outer side thereof in a radial direction of the coupling support boss 39 so as to be capable of rotating relative to the coupling support boss 39.

Figure 7B:
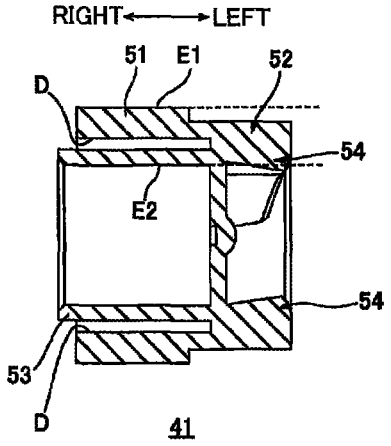
FIG. 7B is a cross-sectional view of the developing coupling in FIG. 6A taken along a line B-B in FIG. 6A.

As shown in FIGS. 6A, 7A, and 7B, the coupling portion 52 is disposed at a substantially left half of the developing coupling 41. The coupling portion 52 has a substantially hollow cylindrical shape that extends leftward from the left wall of the gear portion 51. The coupling portion 52 shares the center axis A1 with the gear portion 51. That is, the coupling portion 52 is coaxial with the gear portion 51. An outer diameter of the coupling portion 52 is smaller than an outer diameter of the gear portion 51. An inner diameter of the coupling portion 52 is greater than the outer diameter of the fitting portion 53. The coupling portion 52 includes a pair of engaging portions 54.

The pair of engaging portions 54 is symmetrically disposed in a radial direction of the coupling portion 52 with respect to the center axis A1 of the coupling portion 52. Each of the pair of engaging portions 54 has a substantially trapezoidal shape in a side view that protrudes radially inward from an inner circumferential surface of the coupling portion 52, and extends in a circumferential direction of the coupling portion 52. Each of the pair of engaging portions 54 includes an engaging surface 54A as an example of a receiving portion.

As shown in FIGS. 4 and 6A, the engaging surface 54A is an upstream end surface of the engaging portion 54 in a clockwise direction in a left side view. As shown in FIG. 6A, a dimension S of the engaging surface 54A in the radial direction is approximately one fourth of a radius R of rotation of the gear portion 51. An imaginary plane PL containing the engaging surface 54A of each engaging portion 54 (indicated by dashed lines in FIG. 6A) does not intersect with the center axis A1 of the coupling portion 52, and extends parallel to the center axis A1 of the coupling portion 52. The imaginary plane PL containing the engaging surface 54A of one of the pair of engaging portions 54 is spaced apart from the imaginary plane PL containing the engaging surface 54A of the other of the pair of engaging portions 54 by a distance L. An outer edge E3 of each engaging surface 54A in the radial direction is positioned inward in the radial direction further than an outer circumferential edge E1 of the gear portion 51, and outward in the radial direction further than an inner circumferential edge E2 of the fitting portion 53 (see also FIG. 7A). An inner edge E4 of each engaging surface 54A in the radial direction is positioned inward in the radial direction further than the inner circumferential edge E2 of the fitting portion 53. That is, the inner edge E4 of the engaging surface 54A is positioned inward in the radial direction further than an outer circumferential surface of the coupling support boss 39.

As shown in FIGS. 3 and 4, the developing gear 42 is disposed diagonally below and rearward of the developing coupling 41. The developing gear 42 has a substantially circular plate shape having a thickness in the left-right direction. The developing gear 42 has gear teeth over an entire circumference thereof. The developing gear 42 is supported at a left end portion of the developing roller shaft 2A so as not to be capable of rotating relative to the developing roller shaft 2A. The developing gear 42 meshes with a lower rear end portion of the gear portion 51 of the developing coupling 41.

The supply gear 43 is disposed below the developing coupling 41. The supply gear 43 has a substantially circular plate shape having a thickness in the left-right direction. The supply gear 43 has gear teeth over an entire circumference thereof. The supply gear 43 is supported at a left end portion of the supply roller shaft 3A so as not to be capable of rotating relative to the supply roller shaft 3A. The supply gear 43 meshes with a lower end portion of the gear portion 51 of the developing coupling 41.

The idle gear 44 is disposed in front of the developing coupling 41. The idle gear 44 is rotatably supported at the left side wall 35L of the developing frame 31. The idle gear 44 integrally includes a large-diameter gear 44A and a small-diameter gear 44B.

The large-diameter gear 44A is disposed at a left end portion of the idle gear 44. The large-diameter gear 44A has a substantially circular plate shape having a thickness in the left-right direction. The large-diameter gear 44A has gear teeth over an entire circumference thereof. The large-diameter gear 44A meshes with a front end portion of the gear portion 51 of the developing coupling 41.

The small-diameter gear 44B has a substantially cylindrical shape that extends rightward from a right surface of the large-diameter gear 44A. The small-diameter gear 44B is coaxial with the large-diameter gear 44A. An outer diameter of the small-diameter gear 44B is smaller than an outer diameter of the large-diameter gear 44A. The small-diameter gear 44B has gear teeth over an entire circumference thereof.

The agitator gear 45 is disposed diagonally below and frontward of the idle gear 44. The agitator gear 45 includes a first gear portion 45A and the second gear portion 45B.

The first gear portion 45A is disposed at a right half of the agitator gear 45. The first gear portion 45A has a substantially circular plate shape having a thickness in the left-right direction. The first gear portion 45A has gear teeth over an entire circumference thereof. The first gear portion 45A meshes with a front end portion of the small diameter gear 44B of the idle gear 44.

The second gear portion 45B is disposed at a left half of the agitator gear 45. The second gear portion 45B has a substantially circular plate shape having a thickness in the left-right direction and overlaps a left surface of the first gear portion 45A when projected in the left-right direction. The second gear portion 45B is coaxial with the first gear portion 45A. An outer diameter of the second gear portion 45B is smaller than an outer diameter of the first gear portion 45A. The second gear portion 45B has gear teeth over an entire circumference thereof.

The detection gear 46 is disposed in front of the agitator gear 45. The detection gear 46 has a substantially circular plate shape having a thickness in the left-right direction. The detection gear 46 is a partially toothless gear in which gear teeth are partially provided on a circumferential surface of the detection gear 46. When a new (i.e. non-used) developing cartridge 1 is first mounted in the apparatus casing 12, the detection gear 46 is brought into meshing engagement with the second gear portion 45B of the agitator gear 45 to start its rotation. Then, the detection gear 46 stops rotating when the detection gear 46 is disengaged from the second gear portion 45B. Incidentally, a control unit (not shown) provided in the apparatus casing 12 determines that the developing cartridge 1 is a new cartridge when the rotation of the detection gear 46 is detected.

4. Apparatus Coupling

Figure 8:
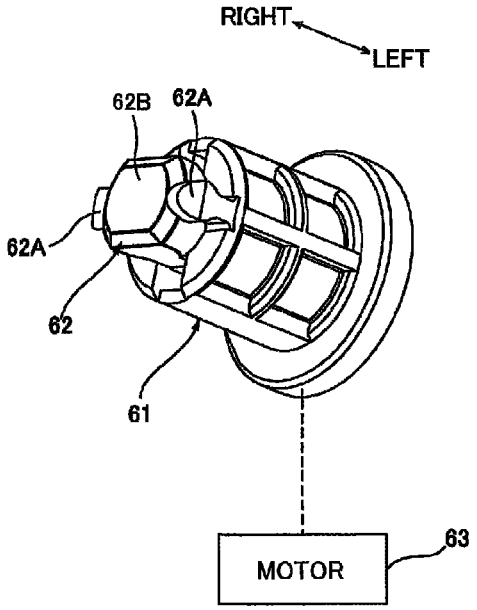
FIG. 8 is a perspective view of an apparatus coupling as viewed from a lower right side thereof.

An apparatus coupling 61 is provided in the apparatus casing 12 at a position leftward of the developing cartridge 1. As shown in FIG. 8, the apparatus coupling 61 has a substantially cylindrical configuration that extends in the left-right direction. The apparatus coupling 61 is movable in conjunction with the movement of the front cover 17 between the open position and the closed position. More specifically, the apparatus coupling 61 retracts leftward so as to be away from the developing cartridge 1 when the front cover 17 is moved to the open position, while the apparatus coupling 61 advances rightward toward the developing cartridge 1 when the front cover 17 is moved to the closed position. The apparatus coupling 61 is connected to a motor 63 as an example of a drive source provided in the apparatus casing 12 so as to be capable of receiving a drive force from the motor 63. The apparatus coupling 61 includes a cylindrical portion, and an engagement portion 62.

The engagement portion 62 is disposed at a right end portion of the apparatus coupling 61. The engagement portion 62 has a substantially cylindrical shape that projects rightward from a right end of the cylindrical portion of the apparatus coupling 61. The engagement portion 62 has a pair of engaging protrusions 62A and a base portion 62B.

Each of the pair of engaging protrusions 62A has a columnar shape that is substantially rectangular in a side view and protrudes outward in a radial direction of the engagement portion 62 from a radially outer surface of the base portion 62B. In other words, the pair of engaging protrusions 62A is symmetrically disposed in the radial direction of the engagement portion 62 with respect to the base portion 62B.

5. Driving of Developing Cartridge

When an operator mounts the developing cartridge 1 in the apparatus casing 12, and closes the front cover 17, the apparatus coupling 61 advances toward the developing cartridge 1.

Referring to FIGS. 3 and 8, the engagement portion 62 of the apparatus coupling 61 is fitted into the coupling portion 52 of the developing coupling 41.

At this time, the pair of engaging protrusions 62A of the apparatus coupling 61 faces the pair of engaging portions 54 of the developing coupling 41 in the circumferential direction, respectively.

When the apparatus coupling 61 rotates in the clockwise direction in a left side view upon receipt of the drive force from the motor 63 provided in the apparatus casing 12, the pair of engaging protrusions 62A of the apparatus coupling 61 abut against the pair of engaging surfaces 54A of the developing coupling 41, respectively, from an upstream side thereof in the clockwise direction in a left side view.

When the apparatus coupling 61 further rotates in this state, the developing coupling 41 rotates clockwise in a left side view together with the apparatus coupling 61 as shown in FIG. 4.

When the developing coupling 41 rotates, the developing gear 42, the supply gear 43, and the idle gear 44 rotate counterclockwise in a left side view.

Hence, the developing roller 2 and the supply roller 3 rotate counterclockwise in a left side view.

When the idle gear 44 rotates counterclockwise in a left side view, the agitator gear 45 rotates clockwise in a left side view.

Hence, the agitator 6 rotates clockwise in a left side view.

6. Operational Advantages (1) According to the developing cartridge 1, as shown in FIG. 7A, each engaging surface 54A has a portion disposed between the inner circumferential edge E2 of the fitting portion 53 that is fitted with the coupling support boss 39, and the outer circumferential edge E1 of the gear portion 51 in the radial direction of the developing coupling 41.

The fitting portion 53 has high rigidity such that the developing coupling 41 can rotate in a stable manner. Further, the gear portion 51 has high rigidity such that the drive force received by the developing coupling 41 can be reliably transmitted to the developing gear 42, the supply gear 43, and the idle gear 44.

Hence, by providing the engaging surfaces 54A at positions between the fitting portion 53 and the gear portion 51 both having high rigidity as described above, rigidity of the engaging surfaces 54A can be ensured, which results in securing of rigidity of the entire developing coupling 41.

Thus, even when a greater drive force is applied to the engaging surfaces 54A from the motor 63 in the apparatus casing 12 through the apparatus coupling 61, the drive force can be stably received by the engaging surfaces 54A.

As a result, the drive force from the motor 63 in the apparatus casing 12 can be efficiently transmitted to the developing roller 2 while suppressing damages to the developing coupling 41.

(2) According to the developing cartridge 1, as shown in FIG. 6A, the radius R of rotation of the gear portion 51 is approximately four times as large as the dimension S of the engaging surface 54A in the radial direction.

Hence, each engaging surface 54A can be disposed so as to be sufficiently spaced apart from the center axis A1 of the developing coupling 41, thereby efficiently transmitting the drive force received by the engaging surfaces 54A to the gear portion 51.

(3) According to the developing cartridge 1, as shown in FIG. 4, the developing coupling 41 overlaps the developing roller 2 when projected in the left-right direction.

Hence, the developing coupling 41 can be disposed efficiently.

(4) According to the developing cartridge 1, as shown in FIG. 7A, the outer circumferential surface of the coupling support boss 39 is positioned outward in the radial direction further than the inner edge E4 of each engaging surface 54A.

Hence, when projected in the left-right direction, the coupling support boss 39 can be disposed so as to overlap the engaging surfaces 54A which are disposed on a radially outer side in the developing coupling 41.

Accordingly, the outer diameter of the coupling support boss 39 can be made as large as possible relative to the outer diameter of the developing coupling 41, thereby ensuring rigidity of the coupling support boss 39.

As a result, the developing coupling 41 can be rotated in a more stable manner.

(5) According to the developing cartridge 1, as shown in FIG. 7A, in the developing coupling 41, the distance D is defined between the fitting portion 53 and the gear portion 51.

In a case where a gap between the fitting portion 53 and the gear portion 51 is filled with a material such as resin, the fitting portion 53 and the gear portion 51 in combination grow in thickness in the radial direction, which may cause sink marks to be formed on circumferential surfaces thereof during a manufacturing process of the developing coupling 41. Further, growing in thickness may degrade precision of the gear teeth formed on the gear portion 51.

The fitting portion 53 and the gear portion 51 can be configured separately with a gap therebetween, thereby precisely forming the fitting portion 53 and the gear portion 51.

(6) According to the developing cartridge 1, the gear portion 51 has gear teeth.

Hence, the drive force can be transmitted to the developing gear 42, the supply gear 43, and the idle gear 44 with a simple configuration.

7. Modifications (1) In the embodiment described above, the developing roller 2 is described as an example of a developer carrier. However, as the developer carrier, for example, a magnetic roller or a brush roller may also be available.

(2) In the embodiment described above, the process cartridge 13 includes the drum cartridge 20 and the developing cartridge 21 separable from the drum cartridge 20. Alternatively, the process cartridge 13 may integrally include a drum unit including the photoconductor drum 21, and a developing unit including the developing roller 2.

(3) In the embodiment described above, the developing gear 42 directly meshes with the gear portion 51 of the developing coupling 41. Alternatively, the developing gear 42 may mesh with the gear portion 51 of the developing coupling 41 through a predetermined intermediate gear.

While the present invention has been described in detail with reference to the embodiment thereof, it would be apparent to those skilled in the art that various changes and modifications may be made therein without departing from the spirit of the present invention.

What is claimed is:

1. A developing cartridge comprising:

a developing roller configured to rotate about a first axis extending in a first direction;

a boss having a cylindrical shape and extending in the first direction; and a coupling configured to rotate about a second axis extending in the first direction, the coupling comprising:

a first hollow cylindrical portion supported by the boss;

a second hollow cylindrical portion surrounding the first hollow cylindrical portion in a radial direction of the first hollow cylindrical portion such that all radii around a circumference of the second hollow cylindrical portion intersect the first hollow cylindrical portion, a space being formed between an inner circumferential surface of the second hollow cylindrical portion and an outer circumferential surface of the first hollow cylindrical portion in the radial direction, the second hollow cylindrical portion having an outer circumferential surface at which a gear portion is provided; and a protrusion configured to receive a drive force from an external drive source, wherein the protrusion has an outer edge in the radial direction, the outer edge of the protrusion being positioned between an outer circumferential edge of the gear portion and an inner circumferential surface of the first hollow cylindrical portion in the radial direction.

2. The developing cartridge as claimed in claim 1, further comprising a developing roller gear supported at the developing roller, the developing roller gear meshing with the gear portion.

3. The developing cartridge as claimed in claim 1, further comprising a casing configured to accommodate a developer therein, wherein the first hollow cylindrical portion has one end and another end in the first direction, the one end of the first hollow cylindrical portion being positioned opposite to the casing with respect to the other end of the first hollow cylindrical portion in the first direction, wherein the coupling has a wall portion having a plate shape and closing the one end of the first hollow cylindrical portion, and wherein the protrusion protrudes from the wall portion.

4. The developing cartridge as claimed in claim 1, wherein the gear portion has a first length in the first direction, the first hollow cylindrical portion having a second length in the first direction, the first length being smaller than the second length.

5. The developing cartridge as claimed in claim 1, wherein the protrusion includes a first protrusion and a second protrusion positioned opposite to the first protrusion with respect to the second axis.

6. The developing cartridge as claimed in claim 1, further comprising a bearing supporting the developing roller, wherein the boss protrudes from the bearing.

7. The developing cartridge as claimed in claim 1, wherein the first hollow cylindrical portion and the second hollow cylindrical portion are integral with each other.

8. A developing cartridge comprising:

a developing roller configured to rotate about a first axis extending in a first direction;

a boss having a cylindrical shape and extending in the first direction; and a coupling configured to rotate about a second axis extending in the first direction, the coupling comprising:

a first hollow cylindrical portion supported by the boss;

a second hollow cylindrical portion surrounding the first hollow cylindrical portion in a radial direction of the first hollow cylindrical portion such that all radii around a circumference of the second hollow cylindrical portion intersect the first hollow cylindrical portion, a space being formed between an inner circumferential surface of the second hollow cylindrical portion and an outer circumferential surface of the first hollow cylindrical portion in the radial direction, the second hollow cylindrical portion having an outer circumferential surface at which a gear portion is provided; and a protrusion configured to receive a drive force from an external drive source, wherein the protrusion has a first edge and a second edge opposite to the first edge in the radial direction, the first edge being positioned closer to the second axis than the second edge to the second axis, a first distance from the second edge to the second axis in the radial direction being greater than an inner diameter of the first hollow cylindrical portion, the first distance being smaller than a second distance from an outer circumferential edge of the gear portion to the second axis.

9. The developing cartridge as claimed in claim 8, further comprising a developing roller gear supported at the developing roller, the developing roller gear meshing with the gear portion.

10. The developing cartridge as claimed in claim 8, further comprising a casing configured to accommodate a developer therein, wherein the first hollow cylindrical portion has one end and another end in the first direction, the one end of the first hollow cylindrical portion being positioned opposite to the casing with respect to the other end of the first hollow cylindrical portion in the first direction, wherein the coupling has a wall portion having a plate shape and closing the one end of the first hollow cylindrical portion, and wherein the protrusion protrudes from the wall portion.

11. The developing cartridge as claimed in claim 8, wherein the gear portion has a first length in the first direction, the first hollow cylindrical portion having a second length in the first direction, the first length being smaller than the second length.

12. The developing cartridge as claimed in claim 8, wherein the protrusion includes a first protrusion and a second protrusion positioned opposite to the first protrusion with respect to the second axis.

13. The developing cartridge as claimed in claim 8, further comprising a bearing supporting the developing roller, wherein the boss protrudes from the bearing.

14. The developing cartridge as claimed in claim 8, wherein the first hollow cylindrical portion and the second hollow cylindrical portion are integral with each other.

15. The developing cartridge as claimed in claim 8, wherein the space extends in a circumferential direction of the first hollow cylindrical portion along the entire circumference of the first hollow cylindrical portion.

16. A developing cartridge comprising:

a developing roller configured to rotate about a first axis extending in a first direction;

a boss having a cylindrical shape and extending in the first direction; and a coupling configured to rotate about a second axis extending in the first direction, the coupling comprising:

a first hollow cylindrical portion supported by the boss;

a second hollow cylindrical portion surrounding the first hollow cylindrical portion in a radial direction of the first hollow cylindrical portion, a space being formed between an inner circumferential surface of the second hollow cylindrical portion and an outer circumferential surface of the first hollow cylindrical portion in the radial direction, the second hollow cylindrical portion having an outer circumferential surface at which a gear portion is provided; and a protrusion configured to receive a drive force from an external drive source, wherein the protrusion has an outer edge in the radial direction, the outer edge of the protrusion being positioned between an outer circumferential edge of the gear portion and an inner circumferential surface of the first hollow cylindrical portion in the radial direction, and wherein the space extends in a circumferential direction of the first hollow cylindrical portion along the entire circumference of the first hollow cylindrical portion.

* * * * *